US005226492A

United States Patent [19]

Solaeche P. et al.

[11] Patent Number: 5,226,492

[45] Date of Patent: Jul. 13, 1993

[54] DOUBLE SEALS PACKERS FOR SUBTERRANEAN WELLS

[75] Inventors: Jose M. Solaeche P., Qta. Nazareno; Jesus R. Rodriguez, Edo. Miranda, both of Venezuela

[73] Assignee: Intevep, S.A., Caracas, Venezuela

[21] Appl. No.: 863,015

[22] Filed: Apr. 3, 1992

[51] Int. Cl.[5] ..... E21B 33/128; F16J 15/08; F16J 15/12

[52] U.S. Cl. ..... 166/196; 166/217; 166/202; 166/387; 277/236; 277/116.6; 277/118

[58] Field of Search ..... 166/196, 217, 202, 387; 277/236, 118, 116.6, 119, DIG. 6

[56] References Cited

U.S. PATENT DOCUMENTS

| | | | |
|---|---|---|---|
| 4,258,926 | 3/1981 | Upton | 166/196 X |
| 4,329,916 | 5/1982 | Roeder | 166/202 X |
| 4,548,265 | 10/1985 | Luke | 166/217 X |
| 4,730,835 | 3/1988 | Wilcox et al. | 166/196 X |
| 4,753,444 | 6/1988 | Jackson et al. | 166/196 X |
| 4,993,489 | 2/1991 | McLeod | 166/196 X |
| 5,010,958 | 4/1991 | Meek et al. | 166/196 X |

*Primary Examiner*—Stephen J. Novosad
*Attorney, Agent, or Firm*—Bachman & LaPointe

[57] ABSTRACT

A well installation is disclosed which has a production casing set in a subterranean well; a production tubing disposed within the production casing; an annular space defined between the production casing and the production tubing; and a packer for sealing the annular space, the packer having: a hollow metallic sleeve disposed on the production tubing, the hollow metallic sleeve having an inner cavity, the inner cavity being open at one end; an expandable member, contained within the inner cavity of the hollow metallic sleeve and extending from the open end of the inner cavity; and a wedge member disposed on the production tubing and contacting the expandable member, whereby compression of the packer causes radial expansion of the expandable member and of the hollow metallic sleeve, and whereby a first seal is formed between the production casing and the expandable member and a second seal is formed between the production casing and the cone-shaped hollow sleeve.

24 Claims, 2 Drawing Sheets

DOUBLE SEALS PACKERS FOR SUBTERRANEAN WELLS

BACKGROUND OF THE INVENTION

The invention relates to a double seal packer for subterranean wells which can be used to isolate two zones in an annular space of such wells.

The use of radially expandable packers, or annular seals, is known in the art. Such devices are frequently used, for example, to seal off a particular formation from the annular space of the well to facilitate hydrocarbon production through a production tubing of the well.

These packers operate through the application, by conventional means, of a compressive force to an elastomeric packer element which, upon longitudinal compression, expands radially to contact the walls of the casing of the well, and effect the desired seal of the annular space at that portion of the well. It has been found, however, that when operated under conditions of extreme temperature the elastomeric seal tends to extrude and reduce the effectiveness of the seal. Such extreme temperatures may be encountered, for example, during steam treatment of a well, or in deep wells which may have oil and sand temperatures in the range of 250–300° F.

Several devices have been proposed attempting to deal with the problem of extrusion of the elastomeric material in order to obtain more effective seals.

For example, U.S. Pat. No. 4,730,835 discloses an anti-extrusion seal element using backup seal elements made of a knitted wire mesh and located at either end of an elastomeric material.

The recurrent heating and cooling accompanying steam treatment methods affect the ability of the elastomeric material and the knitted backup elements to expand and contract as desired, and therefore adversely affect the integrity of the seal achieved by the packer. Further, after a packer of this type is radially expanded in the well bore and subjected to extreme temperatures, the packer may not properly relax after compression is removed, and may therefore require a recovery procedure which increases the down time of the well during treatment.

U.S. Pat. No. 4,326,588 likewise discloses a radially expandable packer wherein an elastomeric material is prevented from extrusion by knitted elements similar to those in U.S. Pat. No. 4,730,835.

U.S. Pat. No. 4,531,581 discloses a piston actuated high temperature well packer wherein elastomeric elements are made of heat resistant material, such as asbestos, and a compression force is achieved through hydraulic means.

Large amounts of gravel or sand are frequently generated within the well during gravel and/or steam injection packing. Thus, another disadvantage in the known art is that the above-described devices are all complicated in nature and susceptible to malfunction when subjected to large volumes of gravel or sand in the well. This gravel also adversely affects the ability of the elastomeric elements of the prior art to maintain the desired seal.

It is thus the principal object of the present invention to provide a radially expandable packer for subterranean well installations which establishes a double seal which is resistant to the effects of fluctuating temperature.

It is a further object of the present invention to provide such a packer which is simple in structure and resistant to the adverse effects of gravel or sand which may be present in large amounts within the well.

SUMMARY OF THE INVENTION

The above objects, and others, are met by a well installation which comprises, according to the invention: a production casing set in a subterranean well; a production tubing disposed within the production casing; an annular space defined between the production casing and the production tubing; and a packer for sealing the annular space, the packer comprising a hollow metallic sleeve disposed on the production tubing, the hollow metallic sleeve having an inner cavity, the inner cavity being open at one end; an expandable member, contained within the inner cavity of the hollow metallic sleeve and extending from the open end of the inner cavity; and a wedge member disposed on the production tubing and contacting the expandable member, whereby compression of the packer causes radial expansion of the expandable member and of the hollow metallic sleeve, and whereby a first seal is formed between the production casing and the expandable member and a second seal is formed between the production casing and the hollow metallic sleeve.

According to a preferred embodiment of the invention, the hollow metallic sleeve has at least one longitudinal slot spaced about a perimeter of the metallic sleeve at desired intervals.

According to a still further preferred embodiment of the invention, the hollow metallic sleeve has an outer circumference and a notch disposed in the outer circumference, the packer further comprising a band of expandable material disposed in the notch of the outer circumference of the hollow metallic sleeve, whereby compression of the packer results in formation of an additional seal between the band of expandable material and the production casing.

BRIEF DESCRIPTION OF THE DRAWINGS

A detailed description of the invention follows, with reference to the attached FIGURES, wherein.

DETAILED DESCRIPTION OF THE INVENTION

With reference to the drawings, the preferred embodiments of the invention will be described.

Figure 1:
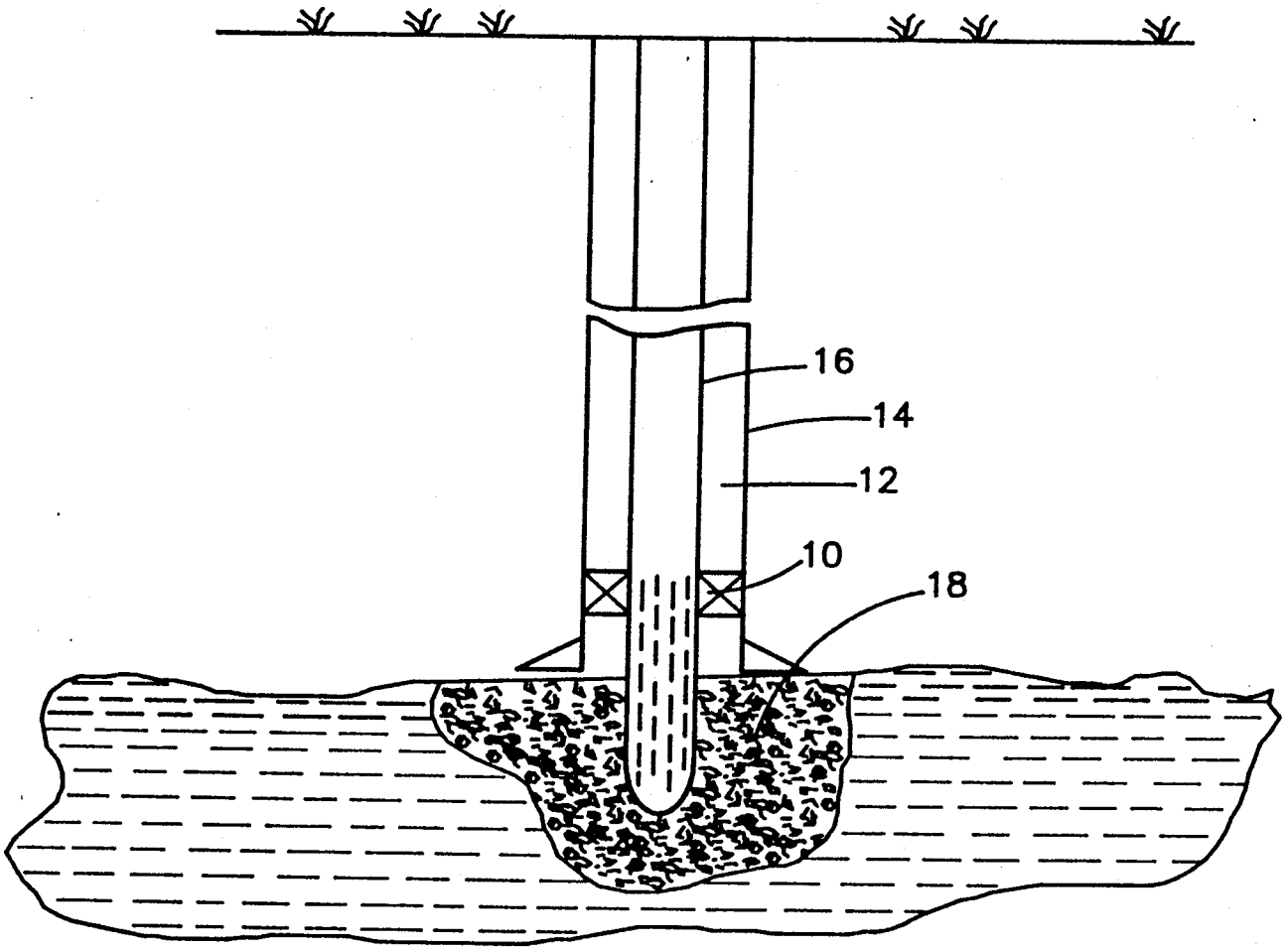
FIG. 1 is an elevational view of a packer in its environment of use.

Referring to FIG. 1., a packer 10 is shown disposed in an annular space 12 defined between a production casing 14 and a production tubing 16. As is known in the art, the packer 10 isolates the annular space 12 from a producing formation 18 so that production can be taken into the production tubing 16.

The invention goes to the structure of a packer, as well as a method of use of the packer and a well installation using the packer, the various elements of which will now be described.

Figure 2:
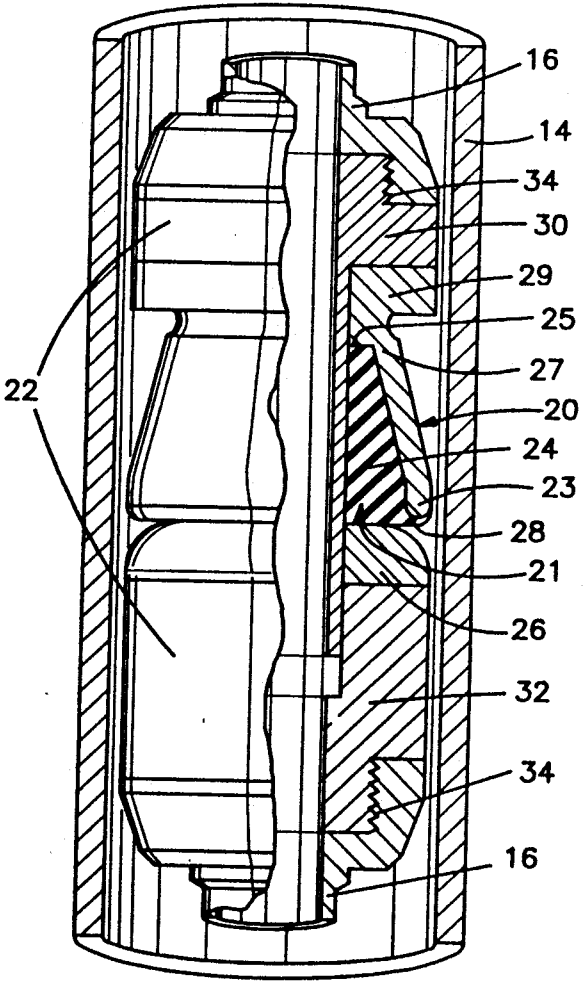
FIG. 2 is an elevational view, partly in cross section, of a packer according to the invention, in an open position.

With reference to FIG. 2, a packer 10 according to the invention is shown disposed upon a production tubing 16 located within a production casing 14.

Packer 10, according to the invention, has the shape of a substantially hollow tubular member having an outer periphery and an inner periphery, the inner periphery defining an opening. The packer includes a deformable hollow metallic sleeve 20 having an inner cavity which has an open end 21. Metallic sleeve 20 defines the outer periphery of packer 10. An expandable member 24 is disposed within the inner cavity and preferably extends from the open end 21 of the cavity. The expandable member 24 at least partially defines the inner periphery of the packer.

The inner periphery, and opening defined thereby, are sized to allow the packer to be disposed over a tubular article defining the inner diameter of an annular space to be sealed by the packer.

The hollow sleeve 20 may preferably have the shape of a hollow cone, the open end 21 of the inner cavity being defined at a wide end 23 of the cone-shaped sleeve 20. The cone-shaped sleeve 20 preferably has a shoulder region 25 against which the expandable member 24 abuts. The sleeve 20 also preferably has a narrowed portion 27 which facilitates deformation of the sleeve 20 during use. The sleeve 20 may also have a base portion 29 which facilitates mounting of the sleeve 20 on a tubular article such as joint 22 of the production tubing 16 as described herein.

The packer 10 is installed for use by placing the hollow metallic sleeve 20 and expandable member 24 over joint 22 of the production tubing 16. Expandable member 24 is disposed within the inner cavity of sleeve 20, and extends from the hollow metallic sleeve 20 at open end 21 of the cavity of sleeve 20.

A wedge member 26 is preferably disposed on the joint 22 of the production tubing 16. The wedge member 26 is located in close proximity to expandable member 24, and preferably contacts the portion 28 of the expandable member 24 which protrudes from open end 21 of hollow metallic sleeve 20. Wedge member 26 serves to transmit a compressive force to expandable member 24 to obtain the desired radial expansion of packer 10 as described below.

Joint 22 of production tubing 16 upon which the packer 10 is mounted preferably includes an inner tubing element 30 and an overlapping tubing element 32. The overlapping tubing element 32 is longitudinally slidable upon the inner tubing element 30 in order to facilitate the transmission of a compressive force to the packer 10 as desired.

Joint 22 of the tubing is connected to the production tubing 16 through conventional connection means 34.

According to a preferred embodiment of the invention, hollow or cone-shaped metallic sleeve 20 is made of a ductile material capable of plastic deformation in the range of 15-20%. Such a material may, for example, be a low carbon steel, or alloys based on copper and/or nickel. Examples of suitable low carbon steel would be, for example, AISI/AE 1008 or 1010.

According to another preferred embodiment of the invention, the expandable member is preferably made from an elastomeric material which maintains resilient properties at deep well temperatures. The material of the expandable member preferably has a SHORE A hardness in the range of, for example, 85-90 as measured by ASTMD-240. This material may most preferably be a graphite/asbestos composition supplied, for example, by the Chesterstone Company.

The wedge member is preferably made of a carbon steel or an alloy which meets the criteria of AISI 4240. The surface of the wedge member may be treated so as to reduce abrasiveness on the expandable member 24. Such a treatment may consist of, for example, a thermal treatment for obtaining a surface hardness in the range of between 25-30 HRc, which surface could be superficially polished to further avoid damage or abrasion to the expandable member. Such a hardened polished surface may be obtained from various superficial metallic treatments which are known in the art, such as hard chrome or any other cadmium plating, galvanization, phosphatization, etc.

Figure 3:
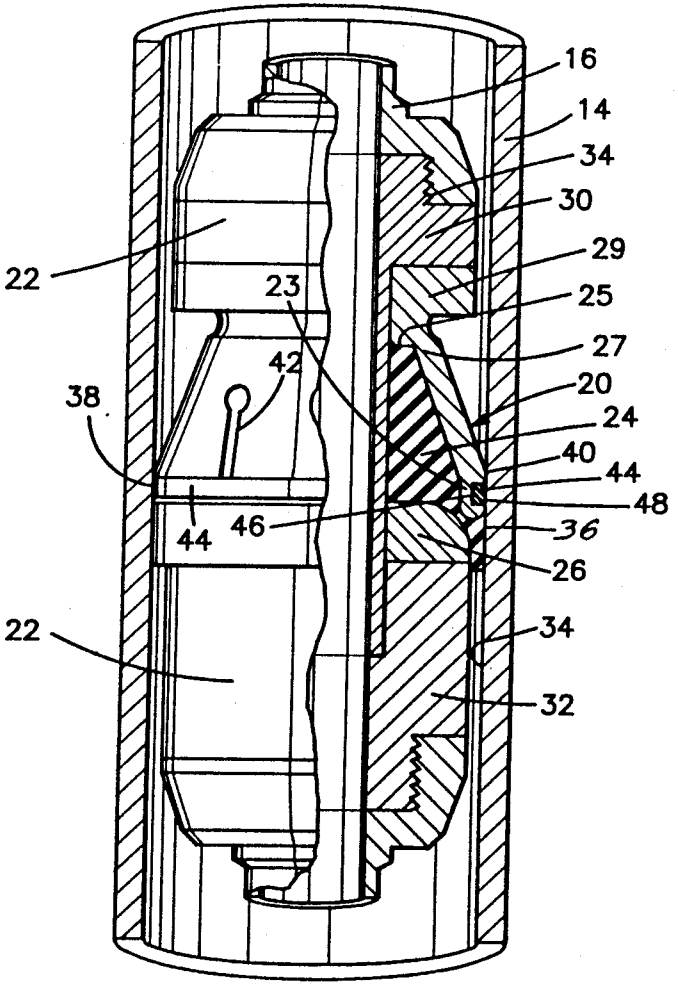
FIG. 3 is an elevational view, partly in cross section, of an alternate embodiment of a packer according to the invention, in a closed position.

With reference to FIG. 3, the operation of the packer 10 according to the invention will be described.

When the packer 10 has been mounted on the joint 22 in the desired location, a compressive force is applied to the packer 10 through any means known to the art. Such a compressive force may be supplied, for example, by resting the bottom of the production tubing in the formation whereby the weight of the production tubing compresses the joint 22, and the packer 10.

The compressive force results in a displacement of the inner tubular element 30 relative to the overlapping tubular element 32. This displacement transmits a force to the wedge member 26 which transmits compressive force to the expandable member 24 and the cone-shaped metallic sleeve 20. This compressive force causes the expandable member 24 and, thus, the cone-shaped metallic sleeve 20 to deform towards the inner wall 34 of the production casing 14. The wedge member 26 has a diameter at a point of contact with the expandable member 24 which is smaller in diameter than the expandable member 24. Compression causes expandable member 24 to be forced around the outside of wedge member 26 and forms a first seal 36 between expandable member 24 and production casing 14.

An expansion force is transmitted to hollow metallic sleeve 20 by the expansion of expandable member 24. This expansion force causes the rim 38 of the wide end 23 of the metallic sleeve 20, and sleeve 20 in general, to deform towards the inner wall 34 of the production casing 14. Rim 38 of metallic sleeve 20 contacts production casing 14, and forms a second seal 40. The combination of the expandable material-metal first seal 36 and the metal-metal second seal 40 provides improved sealing under conditions of extreme temperature and also with gravel treatment. The solid but deformable metallic sleeve 20 prevents extrusion of the expandable member 24 under situations of extreme heat, and protects the expandable member 24 from damaging substances such as gravel.

With further reference to FIG. 3, one or more slots 42 may preferably be spaced at desired intervals around metallic sleeve 20. These slots 42 facilitate deformation of metallic sleeve 20.

A further alternate embodiment, illustrated in FIG. 3, includes an additional band 44 of expandable material which is disposed in a cutout 46 located around the rim 38 of the cone-shaped metallic sleeve. As with the expandable member 24, the additional band 44 may preferably be made from a graphite/asbestos composition having the desired elastomeric properties.

As shown in FIG. 3, a seal obtained using an additional band 44 provides improved sealing due to an additional seal 48 formed between the additional band 44 and the inner wall 34 of the production casing 14.

When packer 10 must be removed, an application of a tensile force will withdraw wedge member 26 from expandable member 24 thus loosening first seal 36 and second seal 40 whereby packer 10 can be removed from the hole.

Thus disclosed is a packer which is simple in structure and which establishes both a metal-metal seal and an expandable material-metal seal in order to maintain the seal through conditions of increased temperature and in the presence of damaging materials such as gravel in the well.

It should be noted that while the preferred embodiments of the invention are described in terms of a packer for use between production tubing and production casing, the teachings of the invention could be used to provide a sealing member for any application having an annular space defined between two tubular elements and, in particular, would be usefully adapted to such other applications where the seal is exposed to high temperatures or abrasive and destructive substances.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A well installation, comprising:

a production casing set in a subterranean well;

a production tubing disposed within said production casing;

an annular space defined between said production casing and said production tubing; and a packer for sealing said annular space, said packer comprising a hollow metallic sleeve disposed on said production tubing, said hollow metallic sleeve having an inner cavity, said inner cavity being open at one end; an expandable member, contained within said inner cavity of said hollow metallic sleeve and extending from said open end of said inner cavity: and a wedge member disposed on said production tubing, facing said open end; said wedge member having a contact surface for contacting said expandable member, whereby compression of said packer causes radical expansion of said expandable member and of said hollow metallic sleeve, and whereby a first seal is formed between said production casing and said expandable member and a second seal is formed between said production casing and said hollow metallic sleeve.

2. A well installation according to claim 1, wherein said wedge member contacts said expandable member through a contact surface which is smaller in diameter than said expandable member so that compression of said packer results in a compression and radial expansion of said expandable member.

3. A well installation according to claim 2, wherein said contact surface of said wedge member is treated to obtain a non-abrasive surface.

4. A well installation according to claim 1, wherein said hollow metallic sleeve is made from a ductile material capable of plastic deformation in a range of 15–20%.

5. A well installation according to claim 1, wherein said hollow metallic sleeve is made from at least one material selected from a group consisting of low carbon steel, alloys based on copper, and alloys based on nickel.

6. A well installation according to claim 1, wherein said hollow metallic sleeve has at least one longitudinal slot spaced about a perimeter of said metallic sleeve at desired intervals whereby deformation of said hollow metallic sleeve is facilitated.

7. A well installation according to claim 1, wherein said hollow metallic sleeve has an outer circumference and a notch disposed in said outer circumference, said packer further comprising a band of expandable material disposed in said notch of said outer circumference of said hollow metallic sleeve, whereby compression of said packer results in formation of an additional seal between said band of expandable material and said production casing.

8. A well installation according to claim 1, wherein said expandable member is made from a graphite and asbestos composition.

9. A packer comprising a substantially hollow tubular member having an outer periphery and an inner periphery said inner periphery defining an opening, said tubular member comprising a hollow metallic sleeve defining said outer periphery and having an inner cavity having an open end, an expandable member contained within said inner cavity and extending from said open end of said hollow metallic sleeve, and a wedge member facing said open end, contacting said expandable member whereby application of a compressive force to said expandable member by said wedge member causes radial expansion of said expandable member, and radial expansion of said hollow metallic sleeve.

10. A packer according to claim 9, further comprising a wedge member, disposed in proximity to said expandable member and having a contact surface for contacting said expandable member, said contact surface being smaller in diameter then said expandable member, wherein said compressive force is applied through said wedge member so that said expandable member expands radially around said wedge and causes radial expansion of said hollow metallic sleeve.

11. A packer according to claim 10, wherein said contact surface of said wedge member is treated to obtain a non-abrasive surface whereby damage to said expandable member caused by said wedge member is reduced.

12. A packer according to claim 9, wherein said hollow metallic sleeve is made from a ductile material capable of plastic deformation in a range of 15–20%.

13. A packer according to claim 9, wherein said hollow metallic sleeve is made from ar least one material selected from a group consisting of low carbon steel, alloys based on copper, and alloys based on nickel.

14. A packer according to claim 9, wherein said hollow metallic sleeve has at least one longitudinal slot spaced about a perimeter of said hollow metallic sleeve at desired intervals.

15. A packer according to claim 9, wherein said hollow metallic sleeve has an outer circumference and said outer circumference has a groove, said packer further comprising a band of expandable material disposed around said outer circumference in said groove, whereby compression of said expandable member further results in radial expansion of said band of expandable material.

16. A packer according to claim 9, wherein said expandable member is made from a graphite and asbestos composition.

17. A well installation, comprising:
a production casing set in a subterranean well;
a production tubing disposed within said production casing;
an annular space defined between said production casing and said production tubing; and
a packer for sealing said annular space, said packer comprising a hollow metallic sleeve disposed on said production tubing, said hollow metallic sleeve having an inner cavity, said inner cavity being open at one end; and expandable member, contained within said inner cavity of said hollow metallic sleeve and extending from said open end of said inner cavity: and a wedge member disposed on said production tubing and contacting said expandable member and of said hollow metallic sleeve, and whereby a first seal is formed between said production casing and said expandable member and a second seal is formed between said production casing and said hollow metallic sleeve wherein said wedge member contacts said expandable member through a contact surface which is smaller in diameter than said expandable member so that compression of said packer results in a compression and radial expansion of said expandable member.

18. A well installation, comprising:
a production casing set in a subterranean well;
a production tubing disposed within said production casing;
an annular space defined between said production casing and said production tubing; and
a packer for sealing said annular space, said packer comprising a hollow metallic sleeve disposed on said production tubing, said hollow metallic sleeve having an inner cavity, said inner cavity being open at one end; and expandable member, contained within said inner cavity of said hollow metallic sleeve and extending from said open end of said inner cavity: and a wedge member disposed on said production tubing and contacting said expandable member and of said hollow metallic sleeve, and whereby a first seal is formed between said production casing and said expandable member and a second seal is formed between said production casing and said hollow metallic sleeve wherein said hollow metallic sleeve has at least one longitudinal slot spaced about a perimeter of said metallic sleeve at desired intervals whereby deformation of said hollow metallic sleeve is facilitated.

19. A well installation, comprising:
a production casing set in a subterranean well;
a production tubing disposed within said production casing;
an annular space defined between said production casing and said production tubing; and
a packer for sealing said annular space, said packer comprising a hollow metallic sleeve disposed on said production tubing, said hollow metallic sleeve having an inner cavity, said inner cavity being open at one end; and expandable member, contained within said inner cavity of said hollow metallic sleeve and extending from said open end of said inner cavity: and a wedge member disposed on said production tubing and contacting said expandable member and of said hollow metallic sleeve, and whereby a first seal is formed between said production casing and said expandable member and a second seal is formed between said production casing and said hollow metallic sleeve wherein said hollow metallic sleeve has an outer circumference and a notch disposed in said outer circumference, said packer further comprising a band of expandable material disposed in said notch of said outer circumference of said hollow metallic sleeve, whereby compression of said packer results in formation of an additional seal between said band of expandable material and said production casing.

20. A well installation, comprising:
a production casing set in a subterranean well;
a production tubing disposed within said production casing;
an annular space defined between said production casing and said production tubing; and
a packer for sealing said annular space, said packer comprising a hollow metallic sleeve disposed on said production tubing, said hollow metallic sleeve having an inner cavity, said inner cavity being open at one end; and expandable member, contained within said inner cavity of said hollow metallic sleeve and extending from said open end of said inner cavity: and a wedge member disposed on said production tubing and contacting said expandable member and of said hollow metallic sleeve, and whereby a first seal is formed between said production casing and said expandable member and a second seal is formed between said production casing and said hollow metallic sleeve wherein said expandable member is made from a graphite and asbestos composition.

21. A packer comprising a substantially hollow tubular member having an outer periphery and an inner periphery said inner periphery defining an opening, said tubular member comprising a hollow metallic sleeve defining said outer periphery and having an inner cavity having an open end and expandable member, contained within said inner cavity and an extending from said open end of said hollow metallic sleeve, whereby application of a compressive force to said expandable member causes radial expansion of said expandable member, and radial expansion of said hollow metallic sleeve, further comprising a wedge member, disposed in proximity to said expandable member and having a contact surface for contacting said expandable member, said contact surface being smaller in diameter than said expandable member, wherein said compressive force is applied through said wedge member so that said expandable member expands radially around said wedge and causes radial expansion of said hollow metallic sleeve.

22. A packer comprising a substantially hollow tubular member having an outer periphery and an inner periphery said inner periphery defining an opening, said tubular member comprising a hollow metallic sleeve defining said outer periphery and having an inner cavity having an open end and an expandable member, contained within said inner cavity and extending from said open end of said hollow metallic sleeve, whereby application of a compressive force to said expandable member, and radial expansion of said hollow metallic sleeve wherein said hollow metallic sleeve has at least one longitudinal slot spaced about a perimeter of said hollow metallic sleeve at desired intervals.

23. A packer comprising a substantially hollow tubular member having an outer periphery and an inner periphery said inner periphery defining an opening, said tubular member comprising a hollow metallic sleeve defining said outer periphery and having an inner cavity having an open end and an expandable member, contained within said inner cavity and extending from said open end of said hollow metallic sleeve, whereby application of a compressive force to said expandable member, and radial expansion of said hollow metallic sleeve wherein said hollow metallic sleeve has an outer circumference and said outer circumference has a groove, said packer further comprising a band of expandable material disposed around said outer circumference in said groove, whereby compression of said expandable member further results in radial expansion of said band of expandable material.

24. A packer comprising a substantially hollow tubular member having an outer periphery and an inner periphery said inner periphery defining an opening, said tubular member comprising a hollow metallic sleeve defining said outer periphery and having an inner cavity having an open end and an expandable member, contained within said inner cavity and extending from said open end of said hollow metallic sleeve, whereby application of a compressive force to said expandable member, and radial expansion of said hollow metallic sleeve wherein said expandable member is made from a graphite and asbestos composition.

* * * * *

UNITED STATES PATENT AND TRADEMARK OFFICE

CERTIFICATE OF CORRECTION

PATENT NO. : 5,226,492

DATED : July 13, 1993

INVENTOR(S) : Jose M. Solaeche P. et al.

It is certified that error appears in the above-identified patent and that said Letters Patent is hereby corrected as shown below:

Claim 1, column 5, line 49 "radical" should read --radial--.

Claim 13, column 6, line 51 "ar" should read --at--.

Signed and Sealed this

First Day of March, 1994

*Attest:*

*Attesting Officer*

BRUCE LEHMAN

*Commissioner of Patents and Trademarks*